United States Patent [19]

Biro

[11] Patent Number: 4,689,933

[45] Date of Patent: Sep. 1, 1987

[54] THERMALLY INSULATED WINDOW SASH CONSTRUCTION FOR A CASEMENT WINDOW

[75] Inventor: Alexander J. Biro, Export, Pa.

[73] Assignee: Winchester Industries, Inc., Saltsburg, Pa.

[21] Appl. No.: 902,426

[22] Filed: Aug. 29, 1986

Related U.S. Application Data

[63] Continuation-in-part of Ser. No. 632,910, July 20, 1984, Pat. No. 4,624,091.

[51] Int. Cl.[4] ..... E04C 2/38

[52] U.S. Cl. ..... 52/656; 52/204; 52/731; 52/475

[58] Field of Search ..... 52/204, 398, 455, 656, 52/730, 731, 788, 790, 475, 731

[56] References Cited

U.S. PATENT DOCUMENTS

| | | | |
|---|---|---|---|
| 3,899,858 | 8/1975 | Zanker | 52/475 X |
| 3,920,344 | 11/1975 | Anderson | 52/656 |
| 4,304,081 | 12/1981 | Dawson | 52/730 X |
| 4,624,091 | 11/1986 | Biro | 52/656 |
| 4,640,048 | 2/1987 | Winner et al. | 52/656 X |
| 4,640,078 | 2/1987 | Haffer | 52/656 X |

FOREIGN PATENT DOCUMENTS

| | | | |
|---|---|---|---|
| 2133517 | 1/1973 | Fed. Rep. of Germany | 52/731 |
| 1940733 | 7/1973 | Fed. Rep. of Germany | 52/731 |
| 2656335 | 6/1978 | Fed. Rep. of Germany | 52/730 |
| 2359956 | 7/1976 | France . | |
| 2508966 | 7/1981 | France | 52/204 |
| 429097 | 7/1967 | Switzerland | 52/475 |
| 2120714 | 12/1983 | United Kingdom | 52/204 |

*Primary Examiner*—William F. Pate, III
*Assistant Examiner*—Creighton Smith
*Attorney, Agent, or Firm*—Parmelee, Miller, Welsh & Kratz

[57] ABSTRACT

A window sash member includes first and second generally parallel sidewalls. First and second spaced, generally parallel transverse walls, extending between and oriented generally perpendicular to the first and second sidewalls, connect the first and second sidewalls to define a first hollow chamber. A third transverse wall, located without the first hollow chamber adjacent to and generally parallel to the first transverse wall, extends from the first transverse wall and terminates short of the second sidewall. A first interior wall, oriented generally parallel to the first sidewall, extends from the third transverse wall to the first transverse wall to define a second hollow chamber. A fourth transverse wall, located without the first hollow chamber adjacent to and generally parallel to the second transverse wall, extends from the first sidewall and terminates short of the second sidewall. A second interior wall, oriented generally parallel to the second sidewall, extends from the fourth transverse wall to the second transverse wall to define a third hollow chamber. A window sash employs at least one of such sash members.

23 Claims, 5 Drawing Figures

THERMALLY INSULATED WINDOW SASH CONSTRUCTION FOR A CASEMENT WINDOW

CROSS-REFERENCE TO RELATED APPLICATION

This application is a continuation-in-part of copending application Ser. No. 632,910 filed July 20, 1984 which issued as U.S. Pat. No. 4,624,091 on Nov. 25, 1986.

BACKGROUND OF THE INVENTION

The invention relates to an improved framing element for a thermally insulated window sash and an improved thermally insulated window sash comprising the framing element. More specifically, the invention relates to such an improved framing element and window sash for a casement window.

Numerous types of window constructions have been used to reduce heat loss from a building or to reduce heat again into a building. One such window construction involves the use of storm windows, placed on the exterior of regular windows to minimize air leakage, heat transfer and undesired condensation on the window interior during cold weather.

Windows having two or more separated panes of glass with a dead air space therebetween that has been evacuated and sealed are known to have improved thermal insulation over single pane windows. However, the seals on such windows can break causing air leakage and moisture condensation between the panes of glass. Damaged panes in such windows can not be replaced without breaking the vacuum seal. Thus, the entire window sash must be replaced in such instances.

Further, thermal breaks, or sealed spaces of dead air within the sash, have been created in window sashes to minimize heat transfer through the window.

Metal sashes, made of materials such as aluminum, have been used for windows; however, because metals are good conductors of heat, condensation on the sashes often occurs. In addition, metals are prone to oxidation, scratching, pitting and denting. Thus, resinous plastic materials, such as vinyl, have been used for window sashes to reduce heat transfer through the window.

In U.S. patent application Ser. No. 632,910 filed July 20, 1984, I disclosed a thermally insulated window sash and sash element particularly for double-hung windows. The window sash element has a plurality of chambers wherein air is trapped and resists heat transfer through the window. Further, glass panes can easily be replaced in the sash by removal of a glazing strip used to secure the panes within the sash. U.S. patent application Ser. No. 632,910 is herein incorporated by reference.

While a number of the above-described advances in the art have improved thermal efficiency by reduced thermal conduction, air leakage and condensation, there remains a very real and subsantial need for further improvements in thermally insulated windows, particularly in thermally insulated casement windows.

SUMMARY OF THE INVENTION

The window sash member of the present invention includes first and second generally parallel sidewalls. First and second spaced, generally parallel transverse walls, extending between and oriented generally perpendicular to the first and second sidewalls, connect the first and second sidewalls to define a first hollow chamber. A third transverse wall, located without the first hollow chamber adjacent to and generally parallel to the first transverse wall, extends from the first transverse wall and terminates short of the second sidewall. A first interior wall, oriented generally parallel to the first sidewall, extends from the third transverse wall to the first transverse wall to define a second hollow chamber. A fourth transverse wall, located without the first hollow chamber adjacent to and generally parallel to the second transverse wall, extends from the first sidewall and terminates short of the second sidewall. A second interior wall, oriented generally parallel to the second sidewall, extends from the fourth transverse wall to the second transverse wall to define a third hollow chamber.

The window sash of the present invention has a plurality of sash members, including generally parallel top and bottom rail members fixedly secured to a pair of spaced stile members, the top and bottom rail members being generally perpendicular to the stile members. At least one of the sash members is a sash member of the invention. Preferably, the bottom rail member is a sash member of the invention and, more preferably, all of the sash members forming the sash are sash members of the invention.

The window sash and window sash member of the invention provide a casement window construction with improved thermal insulation due to the plurality of chambers having air trapped therein which resists heat transfer through the window. A further advantage of the window sash and window sash member of the invention is the ease with which glass panes can be replaced.

These and other objects of the invention will be more fully understood from the following description of the invention and accompanying drawings.

DESCRIPTION OF THE PREFERRED EMBODIMENT

Figure 1:
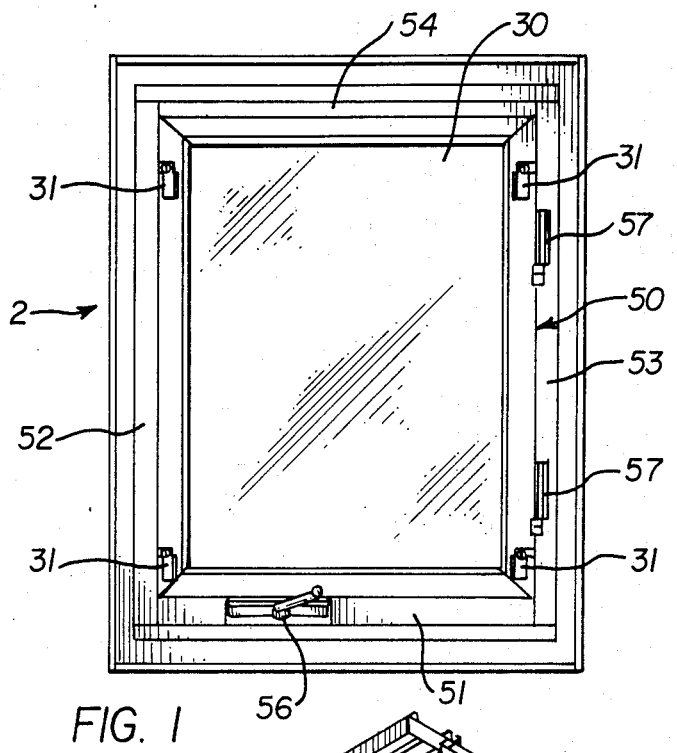
FIG. 1 is a perspective view of a form of casement window employing sash members of the present invention, depicting the window in a closed position.
Figure 2:
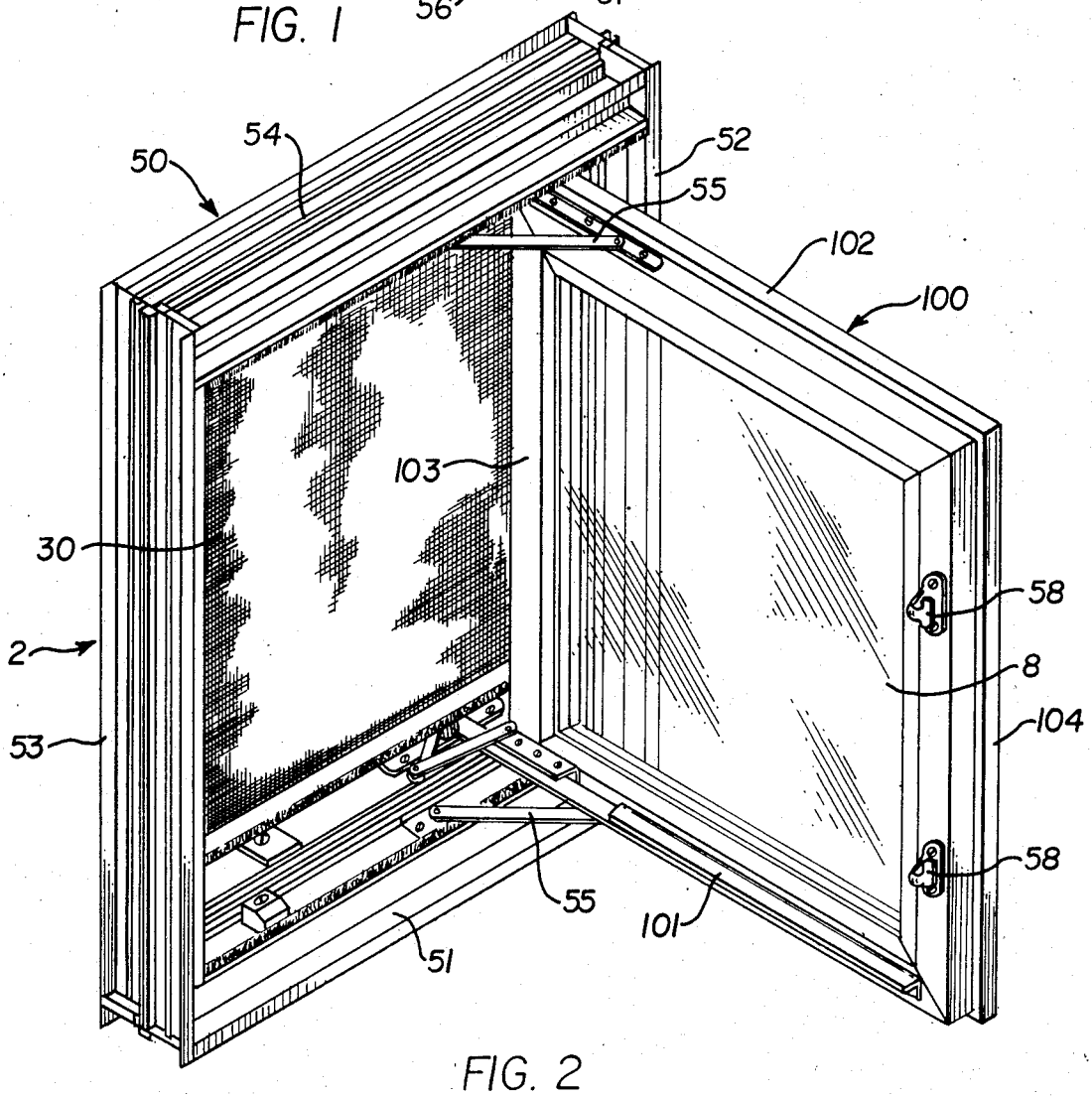
FIG. 2 is a perspective view of a form of casement window employing sash members of the present invention, depicting the window in an open position.

Referring to the figures, window 2 which, in the form shown, is a casement window, includes glass panes 4, 6, and 8, screen 30, sash 100, and window frame 50.

Sash 100 includes four sash members, illustrated as bottom rail 101, top rail 102 and vertical members or stiles 103 and 104. Glass panes 4, 6, and 8 (FIG. 5) are retained within sash 100 and are held in place by glazing strips 170.

Window frame 50 includes sill 51, jambs 52 and 53 and head 54. The components of window frame 50 do not form a part of the invention per se and can take any form that is structurally compatible with the unique window sash framing element of the present invention.

Sash 100 is retained within window frame 50 by linking mechanism 55 connecting sill 51 of frame 50 to bottom rail 101 of sash 100 and head 54 of frame 50 to top rail 102 of sash 100. Clockwise and counterclockwise rotation of handle 56, secured to sill 51 of frame 50, operates linking mechanism 55 to open and close the window, respectively. The window opens outwardly at an angle by rotating about an axis formed by jamb 52 of frame 50. Latch members 57 are secured to jamb 53 of window frame 50 and cooperate with associated keepers 58 in stile 104 of sash 100 to lock and unlock the window by prohibiting or allowing for relative movement, respectively, between sash 100 and window frame 50. Screen 30 is retained within window frame 50 by latch members 31 connected to jambs 52 and 53.

One of the principal elements of the present invention is the uniquely configured sash members and the associated components which combine to create the rail or stile construction.

Figure 3:
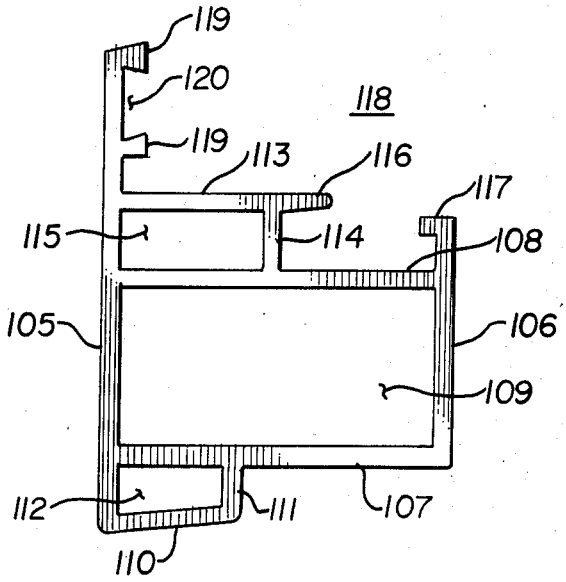
FIG. 3 is an end elevational view of the framing element of the present invention.
Figure 4:
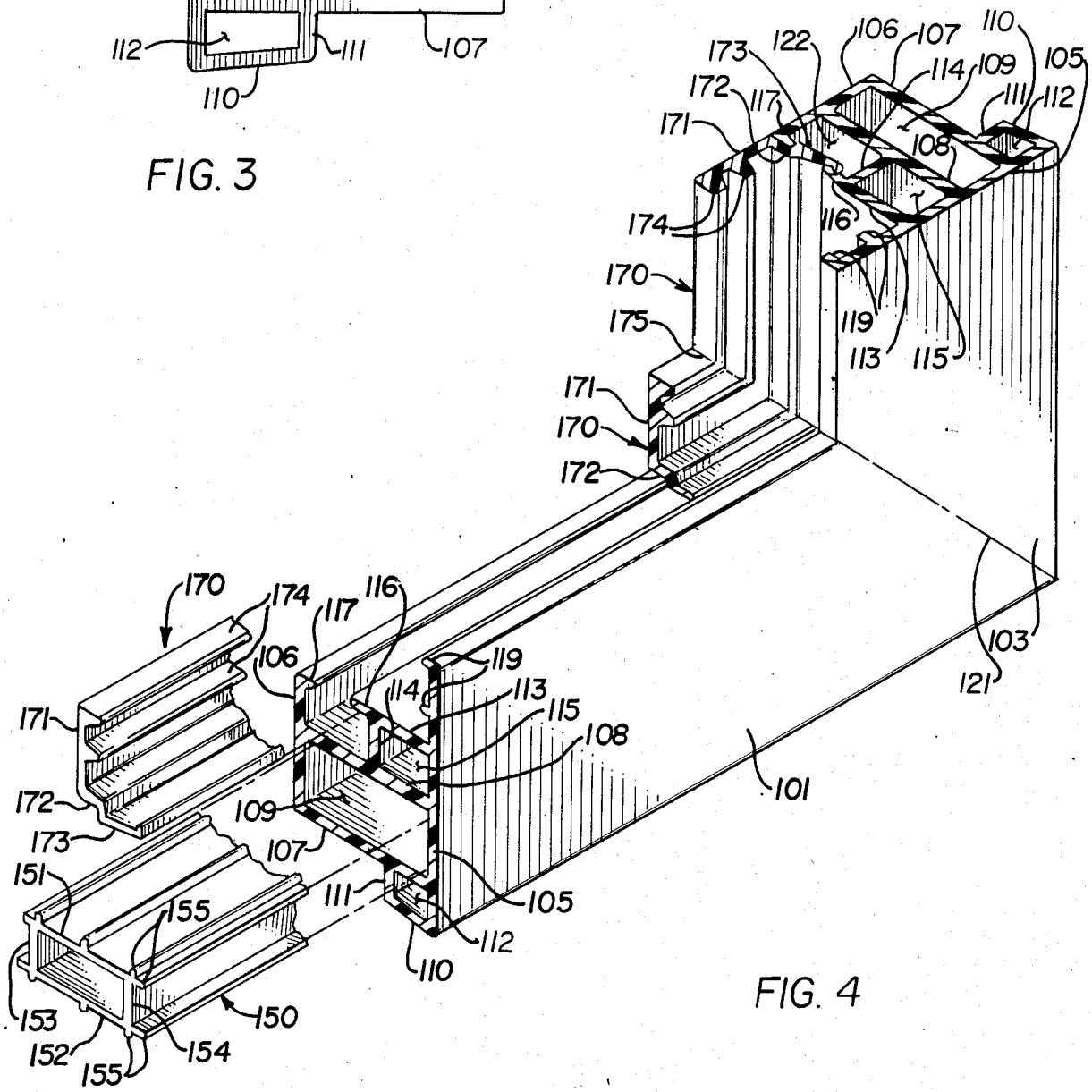
FIG. 4 is a partially exploded, fragmentary perspective view showing a portion of a joint between a sash rail member and sash vertical member of the present invention.
Figure 5:
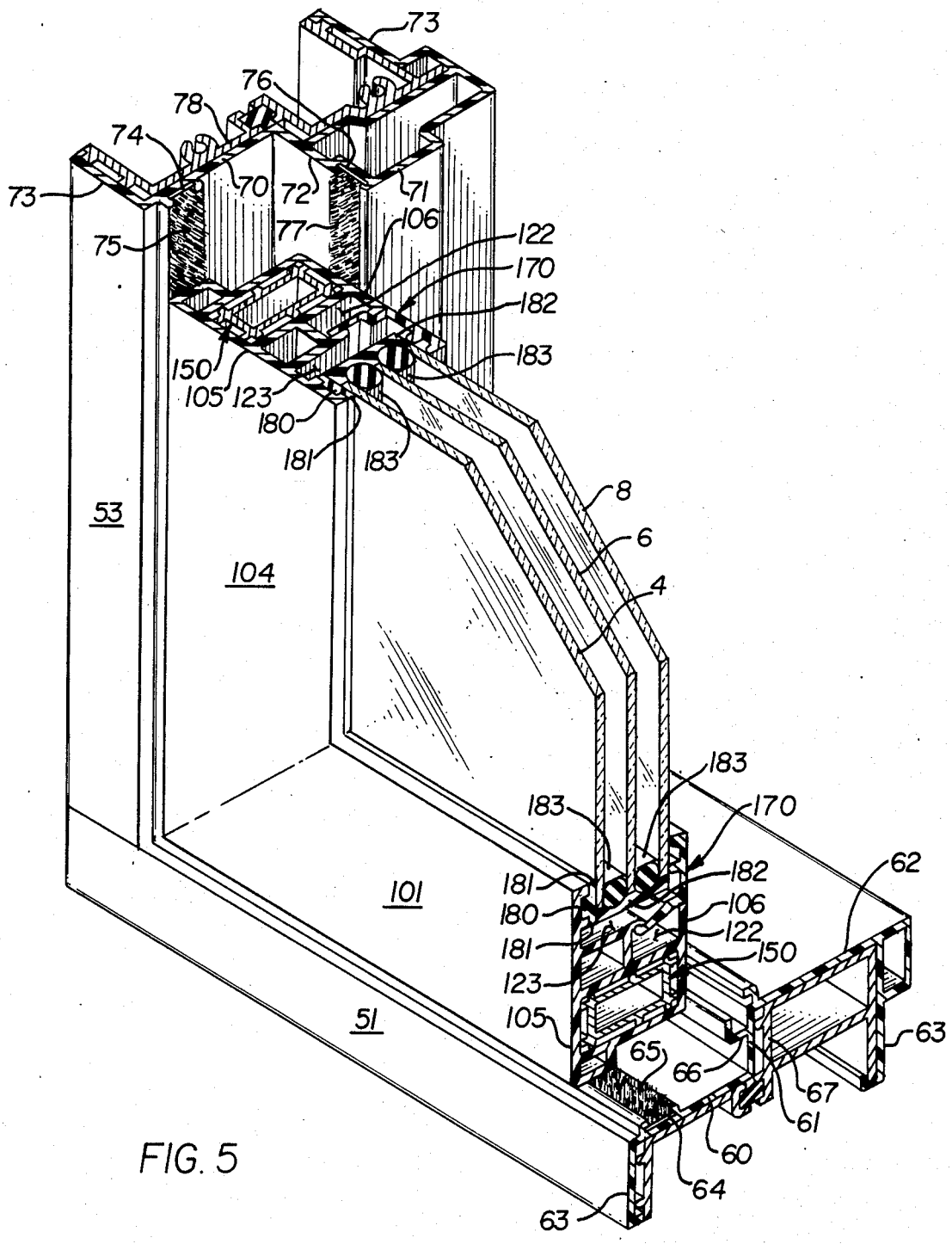
FIG. 5 is a fragmentary perspective view of a portion of the window sash and a portion of the window frame.

The unique aspects of the sash member of the invention will be explained primarily with reference to bottom rail 101, as shown in FIGS. 3, 4, and 5. Corresponding elements are indicated on stiles 103 and 104 in FIGS. 4 and 5, respectively, using the same reference numerals.

Bottom rail 101 has a first sidewall 105 and a second sidewall 106, which is disposed generally parallel with respect to the first sidewall 105. Preferably, the first sidewall 105 extends further upwardly and further downwardly than the second sidewall 106. First and second spaced, generally parallel transverse walls 107 and 108, respectively, connect the sidewalls 105 and 106. First and second transverse walls 107 and 108 are generally perpendicular to first and second sidewalls 105 and 106. The first and second transverse walls 107 and 108 cooperate with portions of the first sidewall 105 and second sidewall 106 to define a first elongated hollow chamber 109 which, in the form shown, is substantially rectangular. Preferably, second side wall 106 terminates at the first transverse wall 107

Third transverse wall 110, located without the first hollow chamber 109 adjacent to and generally parallel to the first transverse wall 107, extends from first sidewall 105 and terminates short of second sidewall 106. Although third transverse wall 110 is described as being generally parallel to first transverse wall 107, preferably third transverse wall 110 extends from first sidewall 105 at a slightly acute angle to allow the sash member to clear the window frame easily as the window is opened and closed while providing a tight seal when the window is closed. Preferably, first sidewall 105 terminates at third transverse wall 110. First interior wall 111 extends from third transverse wall 110 to first transverse wall 107, thus defining a second hollow chamber 112. First interior wall 111 is generally perpendicular to first transverse wall 107 and is generally parallel to first and second sidewalls 105 and 106.

Fourth transverse wall 113, located without the first hollow chamber 109 adjacent to and generally parallel to the second transverse wall 108, extends from the first sidewall 105 and terminates short of second sidewall 106. Second interior wall 114 extends from second transverse wall 108 to fourth transverse wall 113, thus defining a third hollow chamber 115. Second interior wall 114 is generally perpendicular to second and fourth transverse walls 108 and 113 and is generally parallel to first and second sidewalls 105 and 106. Preferably, fourth transverse wall 113 extends beyond second interior wall 114 in the form of extension 116. Generally transversely inwardly directed flange 117 on second sidewall 106 cooperates with portions of second tansverse wall 108, fourth transverse wall 114 and extension 116 thereof to define a recess 118.

First sidewall 105 has a pair of inwardly projecting ribs 119 adjacent to fourth transverse wall 113 and located without third hollow chamber 115 which define gasket retaining recess 120.

As indicated in FIGS. 4 and 5, preferably the sash member of the invention is in the position of the bottom rail member 101. More preferably, bottom rail member 101 has substantially the identical cross-section as top rail member 102 and stiles 103 and 104. These elements are shown as being joined at a miter joint 121 which, in the preferred practice of the present invention, is effected by welding. Further, it will be appreciated that the rails and stiles, except for the joint area, preferably have a substantially uniform cross-section throughout their longitudinal extent.

If desired, weep holes can be provided in portions of first transverse wall 107 and second transverse wall 108 in order to permit any moisture entering recess 118 to drain out of the structure. Such local weep hole discontinuities shall not be deemed, for purposes of the present disclosure, to depart from the cross-section being substantially uniform throughout the longitudinal extent of the rail or stile.

In a preferred practice of the invention, the rail and stile members are formed by extrusion and can be composed of a resinous plastic material such as vinyl. This serves to provide the desired thermal insulation while establishing other desired performance characteristics such as elimination of the need for painting and resistance to chipping, scratching, and other aesthetically unpleasant changes in the article.

While the above-mentioned resinous plastic materials are preferably substantially rigid, in order to further strengthen the structure, it is preferred that a reinforcing member be provided substantially coextensively with the rails. It is not required that the reinforcing members be provided within the stiles, although they could be employed in both the rails and the stiles should such usage be desired. In the form illustrated in FIGS. 4 and 5, reinforcing member 150 is a hollow, generally rectangular element having its major axis in a transverse direction. Generally parallel transverse walls 151 and 152 are separated by generally parallel, spaced sidewalls 153 and 154. Transverse walls 151 and 152 are generally perpendicular to sidewalls 153 and 154. The reinforcing member can preferably be metal such as aluminum extrusion. A preferred feature of this form of reinforcing member is that it substantially completely fill the peripheral portions of the first hollow chamber 109. It will be noted that fin elements 155 project transversely from the reinforcing member to reduce the amount of metal that comes in contact with sidewalls 105 and 106 within first hollow chamber 109 thereby minimizing the likelihood of the reinforcing member permitting conductive heat transfer through the sash framing element.

Glazing strip 170 shown in FIGS. 4 and 5 is generally L-shaped and has a first leg 171 and a second leg 172. Second leg 172 terminates in an enlargement 173 which is intended to be engagd under extension 116 of fourth transverse wall 113. Preferably, when glazing strip 170 is in place within the sash member, first leg 171 is aligned with second sidewall 106, and second leg 172 abuts flange 117 of second sidewall 106 and enlargement 173 engages extension 116 of fourth transverse wall 113 to bridge the gap between second sidewall 106 and second interior wall 114 to create fourth hollow chamber 122. A pair of transversely inwardly directed ribs 174 project from leg 171 and are adapted to engage a surface of one of the glass panes. Another feature of this "drop in" glazing, not shown, is that glazing strip 170 terminates in biased edges 175 which mate with similar edges of the adjacent glazing strips to create a mitered appearance. It is preferred that this miter line be generally aligned with miter joint 121 of the sash. It is the glazing strip, in combination with the uniquely configured sash framing elements, which permits glass to be replaced in the sash without requiring destruction of the miter joint created sash.

Referring to FIG. 5, there is shown a cross-sectional illustration of a sash of the present invention. The sash in this embodiment has three panes of glass 4, 6 and 8 which are disposed in a generally parallel, spaced relationship. Pane 4 is supported adjacent its periphery on one surface by gasket 180 secured in the recess 118 defined within first sidewall 105. In the preferred form as shown, the gasket 180 has a generally T-shaped configuration with shoulders 181 interposed between glass pane 4 and ribs 119 of first sidewall 105 to resist contact therebetween. Among the preferred materials for gasket 180 is ethylene propylene diene methane which is offered under the trade designation EPDM by Lauren Manufacturing Company of New Shiloh, Ohio. Pane 8 has contact along its periphery with transversely inwardly projecting ribs 174 of glazing strip 170. Interposed between glass panes 4, 6 and 8 is E-shaped gasket member 182 and overlying spacer 183 which may take the form of a tubular aluminum extrusion. Spacers 183 can be filled with a suitable dessicant in order to absorb any moisture which might be contained within the air trapped between the glass panes. Preferably, gaskets 180 and 182 are spaced from fourth transverse wall 113 and second leg 172 of glazing strip 170 to create, along with first sidewall 105 and first leg 171 of glazing strip 170, fifth hollow chamber 123.

While for purposes of convenience of illustration herein the preferred system employing three panes of glass has been shown, it will be appreciated that the present invention may also be employed with two panes of glass. For example, if pane 6 were to be eliminated, a gasket bridging the gap between panes 4 and 8 and a spacer similarly bridging the gap could be provided.

Referring to FIG. 5, should it be desired to replace the glass in the window, all that is required is that the glazing strips 170 be removed. This permits free withdrawal of the glass pane assembly from sash 100. The replacement glass may then be inserted and the glazing strips 170 replaced. In general, it will be preferred that the three panes of glass be preassembled and that their edges be sealed throughout, thereby creating a unitary assembly.

As is shown in FIG. 5, the cross-section of sill 51 of window frame 50 includes lower portion 60, step 61, upper portion 62 and legs 63. Lower portion 60 includes channel 64, which supports fibrous gasket 65. Step 61 includes L-shaped fin 66. Lower portion 60 and step 61 support sash 100 when the window is closed and, when the window is closed, bottom rail member 101 of sash 100 is in contact with fibrous gasket 65 and L-shaped fin 66 to effect two seals. Screen 30 is supported by upper portion 62 of frame 50. Reinforcing member 67 supports the structure of sill 51. The cross-section of head 54 of window frame 50 includes the same basic features as sill 51.

As is shown in FIG. 5, the jamb 53 includes outer portion 70, step 71, inner portion 72 and legs 73. Outer portion 70 includes channel 74, which supports fibrous gasket 75. Likewise, step 71 includes channel 76, which supports fibrous gasket 77. Outer portion 70 and step 71 support a stile of sash 100 when the window is closed and, when the window is closed, a stile of sash 100 is in contact with fibrous gaskets 75 and 77 to effect two seals. Screen 30 is supported by inner portion 72 of jamb 53. Reinforcing member 78 supports the structure of jamb 53. The cross-section of jamb 52 of window frame 50 includes the same basic features as jamb 53.

It will be appreciated, therefore, that the present invention has solved a number of previously unsolved problems in respect of providing a functionally effective, aesthetically pleasing, thermally insulated sash member employing multiple panes of glass. In a preferred form, a resinous plastic material provides a framing element which may be employed for both rails and vertical members or stiles and is adapted to cooperate with reinforcing members and suitable glazing strips to thereby provide sufficient strength and structural integrity while facilitating ease of glass replacement and through the use of the welded miter joints, elimination of undesired tolerance and leakage problems. All of this is accomplished in a simple and efficient manner.

Whereas particular embodiments of the invention have been described above for purposes of illustration, it will be evident to those skilled in the art that numerous variations of the details may be made without departing from the invention as defined in the appended claims.

I claim:

1. A window sash member comprising:

first and second generally parallel sidewalls;

first and second spaced, generally parallel transverse walls connecting said first and second sidewalls, extending between and oriented generally perpendicular to said first and second sidewalls to define a first hollow chamber;

a third transverse wall, located without said first hollow chamber adjacent to and generally parallel to said first transverse wall, extending from said first sidewall and terminating short of said second sidewall;

a first interior wall extending from said third transverse wall to said first transverse wall and oriented generally parallel to said first sidewall to define a second hollow chamber;

a fourth transverse wall, located without said first hollow chamber adjacent to and generally parallel to said second transverse wall, extending from said first sidewall and terminating short of said second sidewall; and a second interior wall extending from said fourth transverse wall to said second transverse wall and oriented generally parallel to said second sidewall to define a third hollow chamber.

2. The window sash member of claim 1 wherein said first sidewall extends further upwardly and further downwardly than said second sidewall.

3. The window sash member of claim 1 wherein said first sidewall terminates at said third transverse wall.

4. The window sash member of claim 1 wherein said second sidewall terminates at said first transverse wall.

5. The window sash member of claim 1 wherein said window sash member has a uniform cross-section throughout its longitudinal extent.

6. The window sash member of claim 1 including a glazing strip removably secured to said framing element, said glazing strip having first and second legs generally oriented in an L-shaped, said first leg generally aligned with said second sidewall and said second leg engaging said fourth transverse wall.

7. The window sash member of claim 1 wherein a reinforcing means is disposed within said first hollow chamber.

8. A window sash having a plurality of sash members, including generally parallel top and bottom rail members fixedly secured to a pair of spaced stile members, said top and bottom rail members being generally perpendicular to said stile members, at least one of said sash members comprising:

first and second generally parallel sidewalls;

first and second spaced, generally parallel transverse walls connecting said first and second sidewalls, extending between and oriented generally perpendicular to said first and second sidewalls to define a first hollow chamber;

a third transverse wall, located without said first hollow chamber adjacent to and generally parallel to said first transverse wall, extending from said first sidewall and terminating short of said second sidewall;

a first interior wall extending from said third transverse wall to said first transverse wall and oriented generally parallel to said first sidewall to define a second hollow chamber;

a fourth transverse wall, located without said first hollow chamber adjacent to and generally parallel to said second transverse wall, extending from said first sidewall and terminating short of said second sidewall; and a second interior wall extending from said fourth transverse wall to said second transverse wall and oriented generally parallel to said second sidewall to define a third hollow chamber.

9. The window sash of claim 8 wherein said first sidewall of said sash member extends further upwardly and further downwardly than said second sidewall.

10. The window sash of claim 8 wherein said first sidewall of said sash member terminates at said third transverse wall.

11. The window sash of claim 8 wherein said second sidewall of said sash member terminates at said first transverse wall.

12. The window sash of claim 8 wherein said sash member has a uniform cross-section throughout its longitudinal extent.

13. The window sash of claim 8 wherein a reinforcing means is disposed within said first hollow chamber of said sash member.

14. The window sash of claim 8 including a glazing strip removably secured to said sash member, said glazing strip having first and second legs generally oriented in an L-shape, said first leg generally aligned with said second sidewall of said sash member and said second leg engaging said fourth transverse wall of said sash member.

15. The window sash of claim 14 including a first pane of glass secured within said sash, and a second pane of glass spaced apart from said first pane and secured within said sash.

16. The window sash of claim 15 including a third pane of glass interposed between and spaced apart from said first and second panes of glass.

17. The window sash of claim 8 wherein said sash member is in the position of said bottom rail member.

18. The window sash of claim 17 wherein said top rail member and said stile members are formed as is said bottom rail member.

19. A window sash member comprising:

first and second generally parallel sidewalls;

first and second spaced, generally parallel transverse walls connecting said first and second sidewalls, extending between and oriented generally perpendicular to said first and second sidewalls to define a first hollow chamber;

a third transverse wall, located without said first hollow chamber adjacent to and generally parallel to said first transverse wall, extending from said first sidewall and terminating short of said second sidewall;

a first interior wall extending from said third transverse wall to said first transverse wall and oriented generally parallel to said first sidewall to define a second hollow chamber;

a fourth transverse wall, located without said first hollow chamber adjacent to and generally parallel to said second transverse wall, extending from said first sidewall and terminating short of said second sidewall;

a second interior wall extending from said fourth transverse wall to said second transverse wall and oriented generally parallel to said second sidewall to define a third hollow chamber;

said fourth transverse wall projecting beyond said second interior wall; and said first sidewall, said second sidewall, said fourth transverse wall and said second interior wall defining a recess.

20. The window sash member of claim 19 wherein said second sidewall includes an inwardly directed flange located without said first hollow chamber adjacent to said second sidewall and said first sidewall includes a pair of inwardly directed ribs adjacent to said fourth transverse wall and located without said third hollow chamber.

21. A window sash having a plurality of sash members, including generally parallel top and bottom rail members fixedly secured to a pair of spaced stile members, said top and bottom rail members being generally perpendicular to said stile members, at least one of said sash members comprising:

first and second generally parallel sidewalls;

first and second spaced, generally parallel transverse walls connecting said first and second sidewalls, extending between and oriented generally perpendicular to said first and second sidewalls to define a first hollow chamber;

a third transverse wall, located without said first hollow chamber adjacent to and generally parallel to said first transverse wall, extending from said first sidewall and terminating short of said second sidewall;

a first interior wall extending from said third transverse wall to said first transverse wall and oriented generally parallel to said first sidewall to define a second hollow chamber;

a fourth transverse wall, located without said first hollow chamber adjacent to and generally parallel to said second transverse wall, extending from said first sidewall and terminating short of said second sidewall;

a second interior wall extending from said fourth transverse wall to said second transverse wall and oriented generally parallel to said second sidewall to define a third hollow chamber;

said fourth transverse wall of said sash member projecting beyond said second interior wall; and said first sidewall, said second sidewall, said fourth transverse wall and said second interior wall defining a recess.

22. The window sash of claim 21 wherein said second sidewall of said sash member includes an inwardly directed flange located without said first hollow chamber adjacent to said second sidewall and said first sidewall of said sash member includes a pair of inwardly directed ribs adjacent to said fourth transverse wall and located without said third hollow chamber.

23. A window sash having a plurality of sash members, including generally parallel top and bottom rail members fixedly secured to a pair of spaced stile members, said top and bottom rail members being generally perpendicular to said stile members, at lease one of said sash members comprising:

first and second generally parallel sidewalls;

first and second spaced, generally parallel transverse walls connecting said first and second sidewalls, extending between and oriented generally perpendicular to said first and second sidewalls to define a first hollow chamber;

a third transverse wall, located without said first hollow chamber adjacent to and generally parallel to said first transverse wall, extending from said first sidewall and terminating short of said second sidewall;

a first interior wall extending from said third transverse wall to said first transverse wall and oriented generally parallel to said first sidewall to define a second hollow chamber;

a fourth transverse wall, located without said first hollow chamber adjacent to and generally parallel to said second transverse wall, extending from said first sidewall and terminating short of said second sidewall;

a second interior wall extending from said fourth transverse wall to said second transverse wall and oriented generally parallel to said second sidewall to define a third hollow chamber;

a glazing strip removably secured to said sash member, said glazing strip having first and second legs generally oriented in an L-shaped, said first leg generally aligned with said second sidewall of said sash member and said second leg engaging said fourth transverse wall of said sash member;

a first pane of glass secured within said sash, and a second pane of glass spaced apart from said first pane and secured within said sash; and said first sidewall of said sash member including a pair of inwardly projecting ribs extending from said first sidewall adjacent said third hollow chamber to define a gasket retaining recess; a gasket means in contact with said first pane of glass and retained on said first sidewalls within said gasket retaining recess; and said second pane of glass in contact with a pair of ribs located on and projecting generally transversely inwardly from said first leg of said glazing strip, whereby replacement of one or more of said panes of glass can be effected by removing said glazing strip from said sash.

* * * * *